United States Patent [19]

Deforeit

[11] 4,408,511

[45] Oct. 11, 1983

[54] ELECTRONIC MUSICAL INSTRUMENT

[75] Inventor: Christian J. Deforeit, Trossingen, Fed. Rep. of Germany

[73] Assignee: Matt. Hohner AG, Trossingen, Fed. Rep. of Germany

[21] Appl. No.: 273,903

[22] Filed: Jun. 15, 1981

[30] Foreign Application Priority Data

Jun. 24, 1980 [DE] Fed. Rep. of Germany ..... 3023579

[51] Int. Cl.[3] ..... G10H 1/34

[52] U.S. Cl. ..... 84/1.01; 340/365 S; 340/365 E

[58] Field of Search ..... 84/1.01; 340/365 R, 340/365 S, 365 E

[56] References Cited

U.S. PATENT DOCUMENTS

| | | | |
|---|---|---|---|
| 3,750,160 | 7/1973 | Elzinga | 340/365 |
| 3,899,951 | 8/1975 | Griffith et al. | 84/1.01 |
| 4,134,320 | 1/1979 | Oya | 84/1.01 |

FOREIGN PATENT DOCUMENTS 2711511 9/1977 Fed. Rep. of Germany .

*Primary Examiner*—Stanley J. Witkowski

[57] ABSTRACT

An electronic musical instrument has the switch contacts associated with the keyboard and with the other user operated controls arranged in a single matrix with the switch contacts being grouped in the matrix such that, for example, all of those switches associated with keys are in one corner of the matrix. This arrangement and grouping of switch contacts allows the matrix to be scanned, under the control of logic circuitry, such that those switch contacts associated with the keyboard keys are more frequently scanned than are those switches associated with the other inputs. Information for controlling an audio tone generator is provided in digital form as a function of the state of the contacts of the switches comprising the matrix, the audio frequency signals being digitally synthesized.

4 Claims, 3 Drawing Figures

ELECTRONIC MUSICAL INSTRUMENT

BACKGROUND OF THE INVENTION

1. Field of the Invention

The present invention relates to the electronic production of audible sound and particularly to the exercise of control over electronic musical instruments of the keyboard type. More specifically, this invention is directed to electronic musical instruments having an audio signal generator and operated by means of the actuation of keys and other input mechanisms, such as stops, which maybe associated with switch contacts. Accordingly, the general objects of the present invention are to provide novel and improved methods and apparatus of such character.

2. Description of the Prior Art

Electronic musical instruments are well known in the art. Such instruments typically include a keyboard and additional input mechanisms, known generally as "stops", by which the musician may control the instrument. As used herein, the term "keyboard" is intended to include not only those input devices, i.e., manuals, which are actuated by the musician's fingers, but also to include pedal systems, button systems and other input members which are operated by the musician during the playing of the instrument. The term "stops" as used herein is intended to include those additional input devices by which control over a keyboard instrument is varied such as pull-rods, on-off switches, etc. which determine the tone color of the instrument and which are generally rarely operated during the playing of a particular selection.

An electronic musical instrument of the type generally described above is shown in published Germany Patent Application number 27 11 511. In such instruments the audio frequency signals which are to be delivered to a loudspeaker are digitally synthesized under the control of switch contacts opened and closed by the musician as he manipulates the input devices including the keyboard. In the prior art, the keyboard contacts are disposed in a first matrix while the contacts associate with the "stops" are disposed in a second matrix. The musician's "commands", as determined by the relevant switch positions, are determined by scanning circuits which periodically sense the state of the various switches and transmit the relevant information to associated signal processing circuits. A typical instrument may have two manuals, i.e., two finger responsive keyboards, each of which covers four octaves. The typical instrument may also have "stops" which enable the selection of over ten harmonics and numerous amplitude levels. In many cases, switches are also provided for fixed stops. The wiring of all of the various switches, particularly the numerous connections to the proper signal processing circuits, is a time consuming task. The inspection and servicing of such intricate wiring is also a difficult and time consuming task.

SUMMARY OF THE INVENTION

The present invention overcomes the above-briefly discussed disadvantage of the prior art by providing a control for an electronic musical instrument which may be effected in a less complicated manner than has been the case in prior devices of like character. Apparatus in accordance with the present invention is characterized by less intricate wiring and therefor comparative ease of assembly and servicing.

In accordance with a preferred embodiment of the invention, the switch contacts associated with the keyboard keys and with the stops are arranged in a common sequentially scannable matrix with particularly advantageous contact groupings, and a control is provided which enables the contacts associated with the keys to be scanned at a first or high rate of repetition while the contacts associated with the stops are scanned at a second, lower repetition rate. These dual scanning rates are possible even though the instrument comprises only a single switch matrix by virtue of the fact that the keyboard contacts are located in one corner of the matrix.

An electronic instrument in accordance with the present invention, because of the unique grouping of the contacts of the switch matrix, can have an at least approximately quadratic form, in the case of a single playing matrix, and thus the smallest possible number of electrical feed conductors.

BRIEF DESCRIPTION OF THE DRAWING

The present invention may be better understood and its numerous objects and advantages will become apparent to those skilled in the art by reference to the accompanying drawing wherein.

DESCRIPTION OF THE PREFERRED EMBODIMENT

Figure 1:
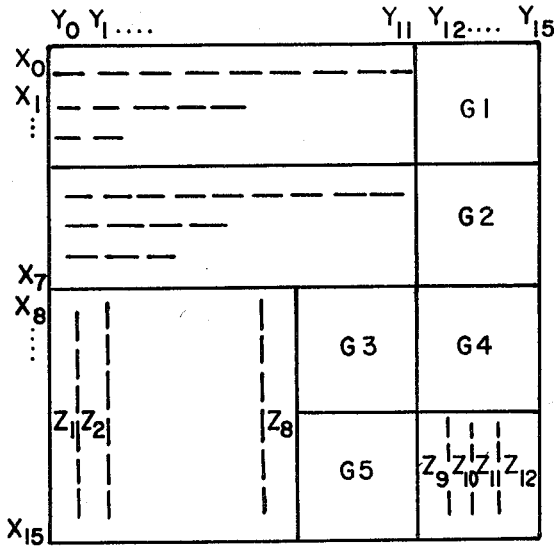
FIG. 1 is a diagramatic showing of a switch matrix for a musical instrument in accordance with the present invention.

Referring first to FIG. 1, a switch matrix having sixteen lines and sixteen columns is represented. The lines are identified as $X_0, X_1 - X_{15}$ while the columns are identified as $Y_0, Y_1 - Y_{15}$. The contacts of a first "manual" comprising four octaves, each of which consists of twelve half-tones, are identified by lines $X_0$ to $X_3$ and the columns $Y_0$ to $Y_{11}$. Thus, the contacts of successive half-tones, i.e., successive columns; each lie in a respective line. In the same manner, the contacts of a second "manual" are defined by lines $X_4$ to $X_7$ and the same columns $Y_0$ to $Y_{11}$. In the example being described, both "manuals" form the keyboard. The stop register comprises five groups, G1 to G5, having in each case sixteen switches. Eight draw-rods, indicated at Z1 to Z8, each defining eight amplitude positions, and four additional draw-rods, indicated at Z9 to Z12, each defining four further amplitude positions, complete the switch matrix.

The connection of the individual contacts of the various switches comprising the matrix to the output terminals thereof is accomplished via diodes in the conventional manner. Accordingly, when the terminals of the matrix are scanned, different logic signal levels will appear depending on the state of the contacts of the switches.

Referring now to the flow diagram comprising FIG. 3, the operation of the control of FIG. 2 in the scanning of the matrix of FIG. 1 will be described. In discussing FIG. 3 the terms "fast" and "slow" scan will be employed. It will be understood, however, that use of these terms is not meant to imply that the actual scanning speed differs. Rather, in the case of a "fast" scan, the matrix terminals in question are looked at more frequently than in the case of a "slow" scan. Thus, a first step in accordance with the invention, indicated at 20, will be to initiate scanning of the matrix. The next step is to determine whether the device is in a "fast" or "slow" scanning mode. This test is indicated at 22. If the device is in a "fast" scanning mode, and if all of the "fast" lines, i.e., keyboard associated lines $X_0$ through $X_7$, have not yet been scanned as determined in step 24, the line number will be incremented by one as indicated at step 26. However, if all of the "fast" lines have been scanned, as indicated by the second output at step 24, the line will be set to X15 as indicated at step 28 and, as indicated at step 30, a test will be made to determine if all of the "fast" columns, i.e., columns $Y_0$ through $Y_{11}$, have been scanned. If all of the "fast" columns have not been scanned, as indicated at step 32 the column scan number will be incremented by one. When all of the "fast" columns have been scanned, and "fast" lines $X_0$ through $X_7$ have thus been scanned twelve times, as indicated by the results of test step 30, the column scanning is set to the "slow" mode (steps 34, 36, 26, 20 and 22). With the "slow" scanning sub-routine commanded at step 22, a new line scanning cycle is commenced. Under this new line scanning cycle, as indicated at step 38, all lines are scanned and, upon the scanning of line $X_{15}$, the operational mode is transfered back to the "fast" scan as indicated at step 40 and the column scan will be incremented by one column; i.e., from column $Y_{12}$ to column $Y_{13}$ for example. Thus, for each scan of a register contact column, one complete line and column scan of the keyboard contacts will be performed. Thus, in the example being described, the keyboard contacts are scanned sixteen times as frequently as the stop or register contacts.

Figure 2:
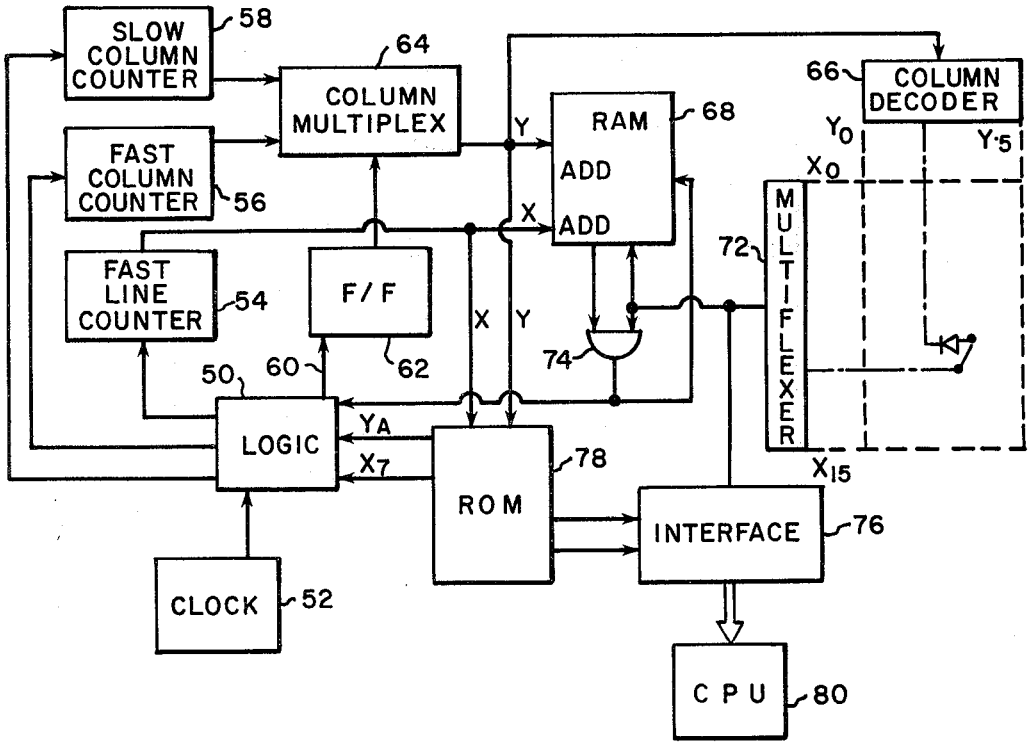
FIG. 2 is a circuit block diagram depicting the electronic subsystems which are connected to a switch matrix of the type depicted in FIG. 1 in accordance with a preferred embodiment of the invention.
Figure 3:
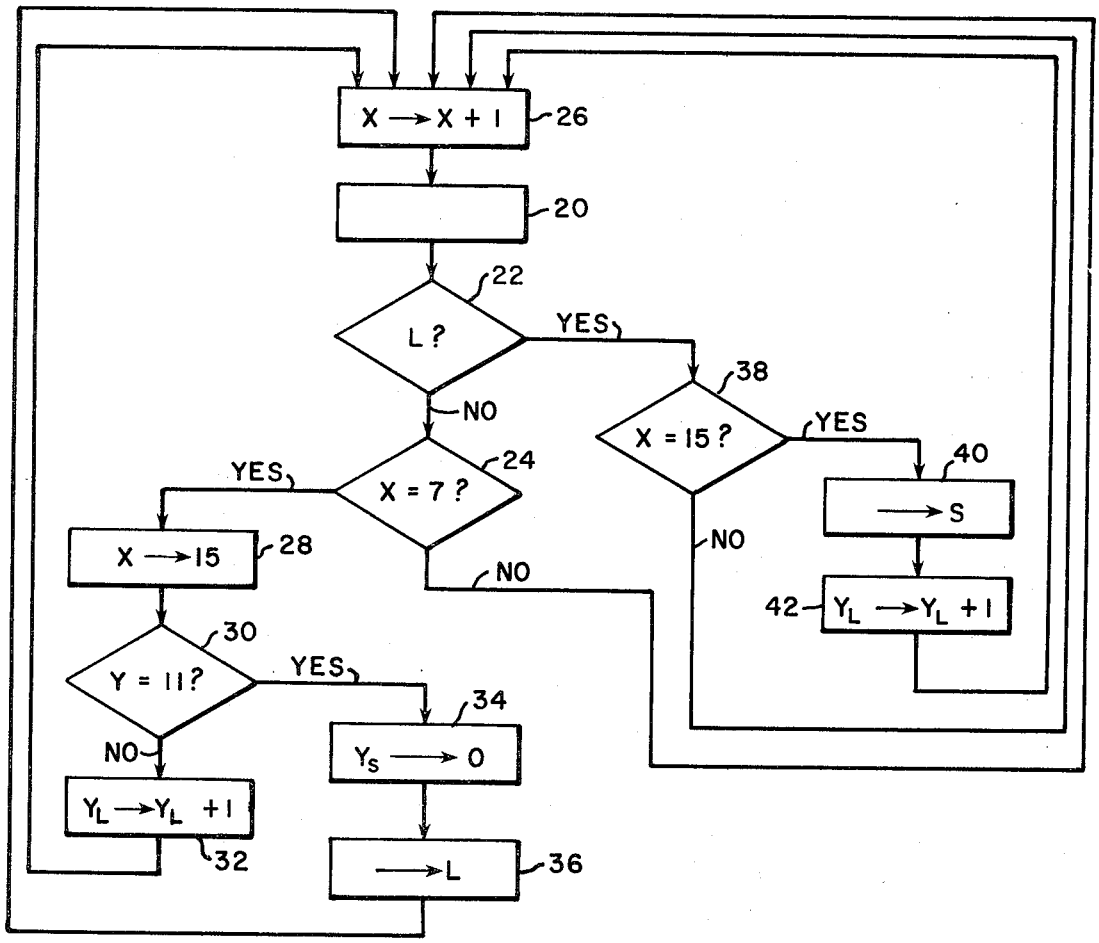
FIG. 3 is an information flow diagram which illustrates the operation of the circuit of FIG. 2.

Referring now to FIG. 2, apparatus in accordance with a preferred embodiment of the present invention includes a logic circuit 50 which receives timing signals from a clock pulse source 52. The output of logic circuit 50 provides excitation to counters 54, 56 and 58 which may, for example, comprise four bit counters. The counter 54 will be associated with the lines of the matrix, the counter 56 will be associated with the "fast" columns of the matrix and counter 58 will be associated with the "slow" columns, i.e., column $Y_{12}$–$Y_{15}$, of the matrix. Logic circuit 50 also provides, on an output 60, an input to a flip-flop circuit 62. The state of circuit 62 provides an indication of whether the "slow" or "fast" scanning mode is in effect. Thus, the output 60 of logic circuit 50 will cause flip-flop 62 to be either set or re-set. The output of flip-flop circuit 62 controls the operation of a column multiplexor 64. The output of multiplexor 64 is delivered to a column decoder 66 which controls the scanning of the matrix.

The output of column multiplexor 64, i.e., the column numbers (Y), is also employed to address a random access memory 68. Similarly, the output (X) of line counter 54 will address memory 68. The lines of the matrix are coupled, via a further line multiplexor 72, to memory 68. An output signal is transmitted, via an OR gate 74, from memory 68 to logic circuit 50 and to RAM 68 if the condition of a switch has changed since the last scan. The "Diff." signal provided at the output of gate 74 will cause the scanning of the matrix to be momentarily interrupted to thereby enable the new input information, commensurate with the change of switch contact state, to be processed.

The contact status is also transmitted, via an interface circuit 76 to a microprocessor 80. In actual practice, the interface circuit 76 will include first in-first out (FIFO) memory or some other circuit by means of which the scan is briefly interrupted when a contact closure occurs whereby noise such as associated with bouncing switch contacts will not be transmitted to microprocessor 80. Thus, only switch changes are outputted to the microprocessor 80 via interface circuit 76. The line and column numbers, respectively from counter 54 and column multiplexor 64, are also employed to address a read only memory 78 and the stored information from memory 78 is delivered, via interface circuit 76, to microprocessor 80. The read-only memory 78 stores information concerning those areas of the matrix which should be scanned frequently, i.e., "fast" or rarely, i.e., "slow". In the example being described, memory 78 will provide input signals to logic circuit 50 when line $X_7$ and column $Y_{11}$ are scanned.

It should be noted that in the event of a change in the matrix layout, for example for different types of instruments, the circuit of FIG. 2 can remain unaltered with the exception of the data concerning the "fast" or "slow" scanning as pre-set into read-only memory 78. The stop contacts will always be capable of being grouped together so that the contact information transmission to the audio signal generator can be accomplished in the least complicated manner. Thus, as indicated in FIG. 1, the eight position draw-rods and four position draw-rods (indicated respectively at a $Z_1$–$Z_8$ and $Z_9$–$Z_{12}$), are each grouped together in one group as are the off switches. The information word to be transmitted to the digital synthesizer may then, for example, be identified in the two first bits whether it corresponds to a keyboard input, large draw-rod, small draw-rod or off switch actuation. The following bits of the information word may then indicate, considering a keyboard contact for example, the contact status, the number of octaves and the number of the half-tone. Similarly, register information can be accommodated in, for example, twelve bit words.

As will now be obvious, the present invention may be used in musical instruments, such as electronic organs, which include one or more synthesizers controlled by a microprocessor, such as microprocessor 80, with associated peripheral equipment for effecting scanning of the input switch matrix. The microprocessor and its peripherals will form the external control of the synthesizer which may, for example, be of the general type disclosed in my copending application Ser. No. 235,843, filed Feb. 19, 1981.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In an electronic musical instrument having plural inputs, the inputs including key operated switches and operator adjustable input devices for setting additional switches in pre-selected positions, the state of the switch contacts being scanned to provide control signals for a tone generator, the improvement comprising:

means connecting the contacts of the key operated and additional switches in a matrix defining rows and columns, the contacts of the key operated switches all being interconnected to define a first block within the matrix, sequential row and column scanning of said first block of the matrix sampling the state of only key operated switches, the contacts of the additional switches being connected to define at least a first additional block within the matrix, the first contacts of switches comprising said first additional block at least in part defining columns of the matrix which are not encompassed by the said first block, the scanning of a single row of the matrix including the scanning of second contacts of such additional switches; and control means for determining the pattern of scanning of said matrix, said control means scanning said first matrix block at a first repetition rate and the additional switches at a repetition rate which is lower than the said first rate, said control means scanning at least a different one of the columns of the matrix which comprises said additional block after each complete scan of said first block of the matrix.

2. The apparatus of claim 1 wherein said control means comprises:

means for sensing a change of state of the scanned switch contacts and for generating a signal commensurate therewith.

3. The apparatus of claim 2 wherein said control means further comprises:

means responsive to a signal commensurate with a change of switch contact state for terminating the scanning of the matrix for a preselected time to permit the input information commensurate with the change of switch contact state to be processed.

4. The apparatus of claim 3 further comprising:

means for delaying the transmission of information commensurate with a change of state of switch contacts to the tone generator of the instrument whereby the tone generator will be isolated from noise resulting from switch contact closure.

* * * * *